US008151932B2

(12) United States Patent
Inoue

(10) Patent No.: US 8,151,932 B2
(45) Date of Patent: Apr. 10, 2012

(54) MUFFLER DEVICE FOR MOTORCYCLE

(75) Inventor: Yusuke Inoue, Wako (JP)

(73) Assignee: Honda Motor Co., Ltd, Minato-Ku, Tokyo (JP)

( * ) Notice: Subject to any disclaimer, the term of this patent is extended or adjusted under 35 U.S.C. 154(b) by 0 days.

(21) Appl. No.: 12/716,424

(22) Filed: Mar. 3, 2010

(65) Prior Publication Data

US 2010/0243371 A1 Sep. 30, 2010

(30) Foreign Application Priority Data

Mar. 31, 2009 (JP) ..... 2009-088444

(51) Int. Cl.
*F01N 13/00* (2010.01)

(52) U.S. Cl. ..... 181/227; 181/228

(58) Field of Classification Search ..... 181/227, 181/228, 248, 249
See application file for complete search history.

(56) References Cited

U.S. PATENT DOCUMENTS

| | | | | | |
|---|---|---|---|---|---|
| 2,979,357 | A * | 4/1961 | Leach et al. | ..... | 293/113 |
| 4,192,402 | A * | 3/1980 | Nakagawa et al. | ..... | 181/256 |
| 4,354,573 | A * | 10/1982 | Tabata et al. | ..... | 181/239 |
| 5,633,482 | A * | 5/1997 | Erion et al. | ..... | 181/282 |
| 5,726,397 | A * | 3/1998 | Mukai et al. | ..... | 181/232 |
| 7,374,016 | B2 * | 5/2008 | Yamaguchi et al. | ..... | 181/249 |
| 7,464,789 | B2 * | 12/2008 | Yamamoto et al. | ..... | 181/256 |
| 2002/0134614 | A1 * | 9/2002 | Chen | ..... | 181/252 |
| 2004/0089500 | A1 * | 5/2004 | Lewis | ..... | 181/249 |
| 2004/0238273 | A1 * | 12/2004 | Fritskey et al. | ..... | 181/264 |
| 2006/0048993 | A1 * | 3/2006 | Karube et al. | ..... | 180/296 |
| 2006/0096805 | A1 * | 5/2006 | Staut | ..... | 181/271 |
| 2008/0053748 | A1 * | 3/2008 | Emler | ..... | 181/212 |

FOREIGN PATENT DOCUMENTS

| | | | |
|---|---|---|---|
| JP | 59-10338 | | 4/1984 |
| JP | 06248942 | A * | 9/1994 |
| JP | 09002083 | A * | 1/1997 |

* cited by examiner

*Primary Examiner* — Jeremy Luks
(74) *Attorney, Agent, or Firm* — Squire Sanders (US) LLP

(57) ABSTRACT

An exhaust outlet 34 is formed at the center of a rear end wall 46 of a tail cap 21 closing a rear end opening of a muffler body 20, and a tail pipe 30 is connected at its rear end to the exhaust outlet 34. The exhaust outlet 34 is formed through a tail pipe supporting member 35 mounted on the rear end wall 46. The tail pipe supporting member 35 is formed with an annular mud guiding groove 37 opening rearward around the exhaust outlet 34. The mud accumulated on the rear end wall 46 is guided into the mud guiding groove 37 and moved in the mud guiding groove 37 owing to its capillarity. Accordingly, the mud can be moved down along the mud guiding groove 37 and smoothly dropped to the ground, thus preventing the clogging of the exhaust outlet 34 with the mud on the rear end wall 46.

8 Claims, 9 Drawing Sheets

MUFFLER DEVICE FOR MOTORCYCLE

BACKGROUND

1. Field

Embodiments of the present invention relate to a muffler device for a motorcycle suitable for running on a muddy road, such as for a motocross race.

2. Description of the Related Art

Conventionally known is a muffler device for a motorcycle including an outer pipe connected to the rear end of an exhaust pipe, a conical tail cap closing a rear end opening of the outer pipe, and a tail pipe having a rear end exposed to an exhaust outlet formed through the tail cap (see Japanese Utility Model Publication No. Sho 59-10338).

In the case of an off-road vehicle, especially an off-road race vehicle, a large amount of mud is scattered and there is a possibility that a muffler may be muddied. Further, a muffler shape is limited in such a manner that no projections and depressions must be formed on the muffler due to race strategy and regulation. Accordingly, it is difficult to form a mudguard for the muffler.

Further, in the case that the rear end of a muffler device is positioned on the front side of a vertical line tangent to the outer circumference of a rear wheel at its rear end for the purpose of mass concentration, the muffler is easily covered with the mud and water splashed by the rear wheel from the viewpoint of the positional relation between the muffler and the rear wheel. Accordingly, particularly in the case that the above-mentioned layout of the muffler is adopted, it is desirable to effectively remove the mud from the muffler with a simple structure.

SUMMARY

In accordance with embodiments of the invention, there is provided a muffler device for a motorcycle including an exhaust pipe having one end connected to an exhaust port of an engine and a muffler connected to the other end of the exhaust pipe. The muffler includes a muffler body as an outer member, a tail cap closing a rear end opening of the muffler body, an inner pipe accommodated in the muffler body, and a tail pipe accommodated in the muffler body and connected to the inner pipe. The inner pipe may have one end connected to the exhaust pipe, and the tail pipe may have one end connected to an exhaust outlet formed through the tail cap. The tail cap is formed with an annular mud guiding groove as a narrow groove surrounding the exhaust outlet.

In accordance with one embodiment, the muffler further includes a tail pipe supporting member for supporting one end of the tail pipe, the tail pipe supporting member being integrated with the tail cap and having the exhaust outlet and the mud guiding groove.

In accordance with another embodiment, one end of the tail pipe supported by the tail pipe supporting member is formed as a cut edge portion, and the tail pipe supporting member is formed with an annular folded portion for covering the cut edge portion.

In accordance with one embodiment, the tail cap is further formed with a second mud guiding groove extending substantially straight downward from a lowermost end of the annular mud guiding groove.

As a result of certain embodiments, the mud dropped onto the tail cap flows along the curved surface of the tail cap having a conical shape toward the exhaust outlet. However, since the mud guiding groove is formed on the tail cap so as to surround the exhaust outlet, the mud is guided into the mud guiding groove and moved downward along the mud guiding groove around the exhaust outlet.

Furthermore, since the mud guiding groove is formed as a narrow groove capable of exhibiting capillarity, the mud in the mud guiding groove can be smoothly moved downward around the exhaust outlet by the capillarity. Accordingly, the accumulation of mud on the outer surface of the tail cap around the exhaust outlet can be suppressed.

According to an embodiment of the invention, the tail pipe supporting member as a small part is formed with the mud guiding groove. Accordingly, the mud guiding groove can be easily formed. Furthermore, in the case of modifying the tail pipe to have different specifications such as changing an outer diameter, it is only necessary to change the design of the tail pipe supporting member. Accordingly, a change in design of the tail cap as a whole can be avoided, thereby improving the flexibility of design.

According to another embodiment, the tail pipe supporting member is formed with the folded portion, and the cut edge portion of the tail pipe is covered with the folded portion. Accordingly, edge treatment for the cut edge portion of the tail pipe can be facilitated.

According to an example of the invention, the mud and water in the mud guiding groove can be smoothly dropped through the second mud guiding groove to the ground.

DETAILED DESCRIPTION

Figure 1:
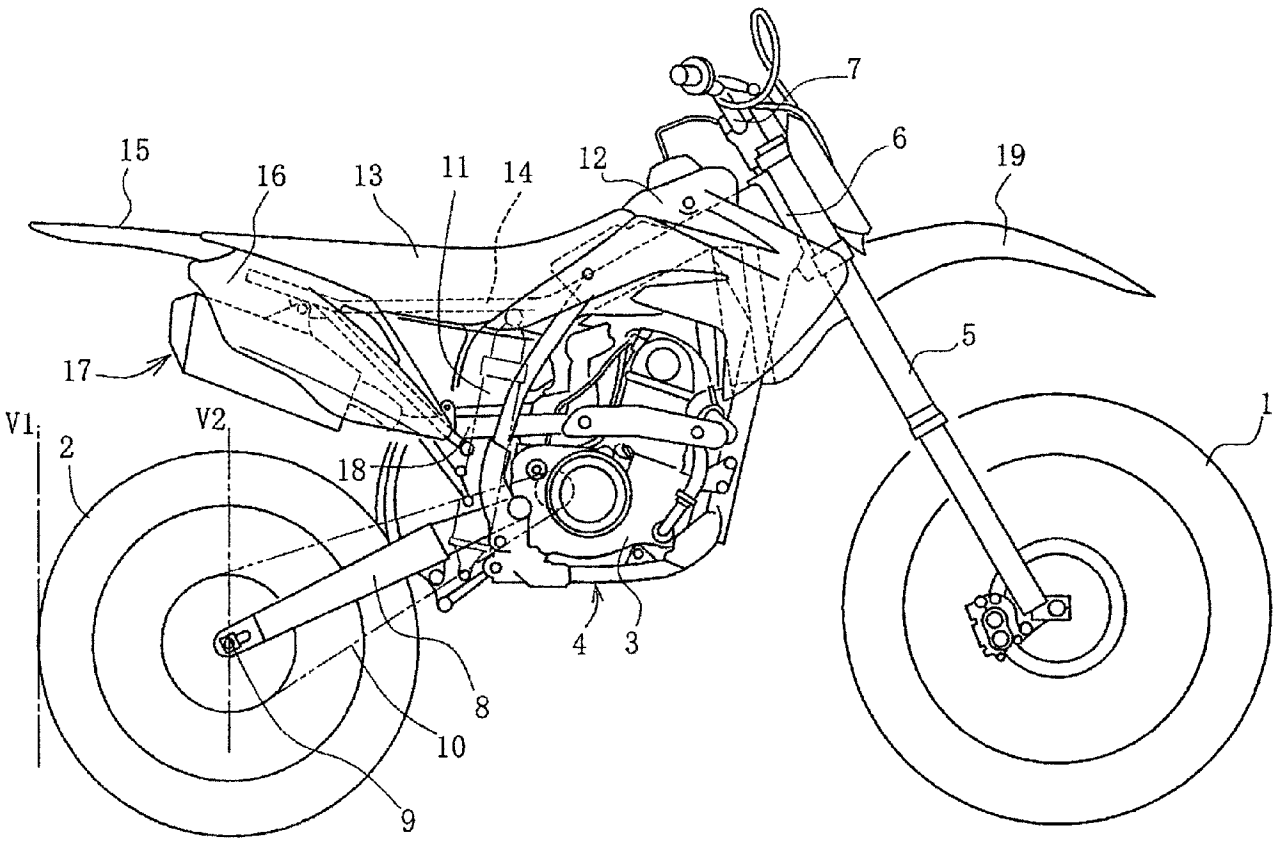
FIG. 1 is a side view of a motorcycle using a muffler device according to one embodiment of the present invention.

Some embodiments of the present invention will now be described with reference to the drawings. FIG. 1 is a side view of a racer type motorcycle for a motocross race using a muffler device according to an embodiment of the present invention.

As shown in the example of FIG. 1, an engine 3 is mounted on a cradle type frame 4 between a front wheel and a rear wheel 2. The front wheel 1 is pivotably supported through a front fork 5 to a head pipe 6 provided at the front end of the frame 4. The front wheel 1 is steered by a steering handle 7. The front fork 5 may be of a telescopic type having a large stroke, thereby ensuring a large stroke of the front wheel 1.

In one embodiment, a rear swing arm 8 is pivotably supported at its front end to a rear portion of the frame 4. The rear wheel 2 is supported through an axle 9 to the rear end of the rear swing arm 8. The rear wheel 2 is driven by a chain 10. A rear cushion unit 11 may be provided between the rear swing arm 8 and a rear portion of the frame 4 so as to ensure a large stroke of the rear wheel 2.

A fuel tank 12 can be located above the engine 3 in the vicinity of the front fork 5 and supported to the frame 4. A seat 13 may be located behind the fuel tank 12 and supported on a seat rail 14 extending rearward from a rear upper portion of the frame 4.

According to certain embodiments, a rear fender 15 extends rearward from the under side of the seat 13 so as to cover the upper side of the rear wheel 2. The rear fender 15 functions as a mudguard for preventing a splash from the rear wheel 2. A pair of right and left rear side covers 16 may be provided on the right and left sides of the vehicle body so as to cover the lower side of a rear portion of the seat 13 and the right and left sides of a front portion of the rear fender 15.

A muffler device 17, in one embodiment, is provided so as to be surrounded by the rear fender 15 and the rear side covers 16. The muffler device 17 can be of a short muffler type such that a muffler is located so as to be shifted toward the front side of the vehicle body for the purpose of mass concentration. The rear end of the muffler device 17 is located on the front side of a vertical line V1 tangent to the outer circumference of the rear wheel 2 at its rear end. Further, the rear end of the muffler device 17 is located on the slightly rear side of a vertical line V2 passing through the axle 9 of the rear wheel 2. Further, the muffler device 17 may have a short length such that the front end of the muffler device 17 is located on the rear side of the front end of the rear wheel 2. A part of the rear end portion of the muffler device 17 is not covered with the right rear side cover 16.

The front end of the muffler device 17 is connected to the rear end of an exhaust pipe 18. The exhaust pipe 18 extends substantially horizontally in the longitudinal direction of the vehicle along the right side of the engine 3, and the front end of the exhaust pipe 18 is connected to an exhaust port opening to the front surface of the engine 3.

In one embodiment, the space between the muffler device 17 and the upper end of the rear wheel 2 is set relatively large, so as to ensure a large stroke of the rear wheel 2. As mentioned above, the muffler device 17 may be of a short muffler type, which contributes to mass concentration.

Figure 2:
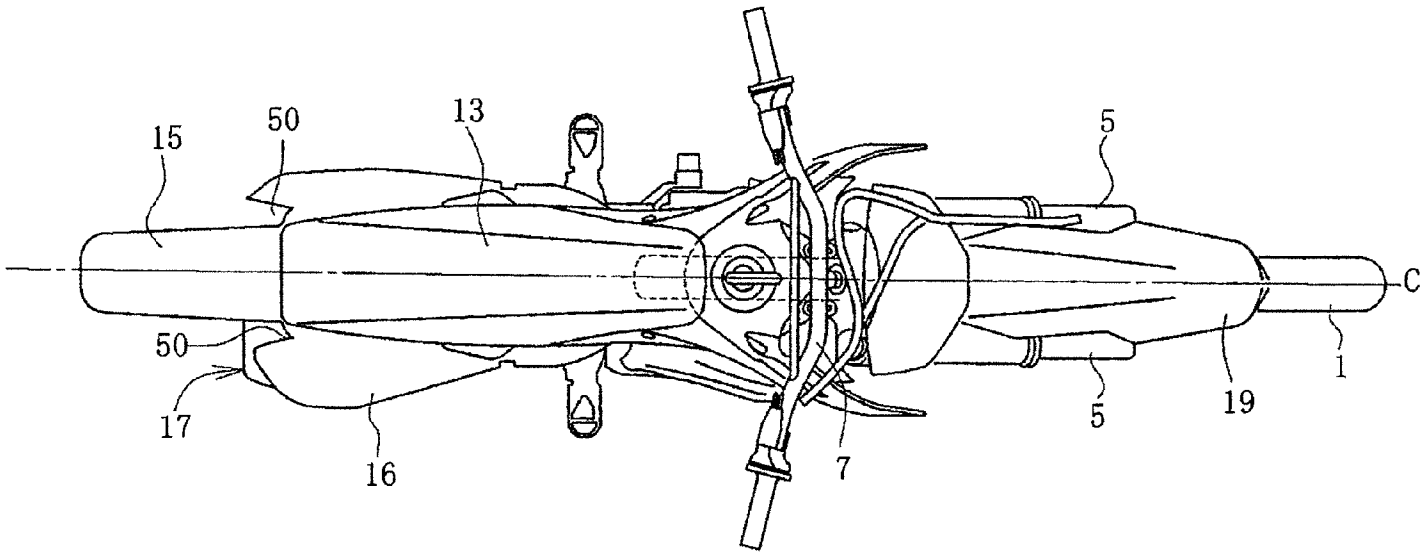
FIG. 2 is a plan view of the motorcycle shown in FIG. 1.

FIG. 2 is a plan view of the motorcycle shown in FIG. 1, according to one embodiment. As shown in the example of FIG. 2, the front fork 5 is composed of a pair of right and left members, and the steering handle 7 is a bar handle extending in the lateral direction of the vehicle. Reference numeral 19 denotes a front fender. In this embodiment, the seat 13 extends long and narrowly in the longitudinal direction of the vehicle, and the rear fender 15 extends long rearward from the rear end of the seat 13. The right and left rear side covers 16 are provided on the right and left sides of a rear portion of the seat 13. The right rear side cover 16 may be larger in width than the left rear side cover 16, so as to cover the muffler device 17.

According to some embodiments, the right and left side edges of the rear fender 15 are continuously connected to the rear ends of the right and left rear side covers 16, respectively. The connected portion of the rear fender 15 and each rear side cover 16 can be formed with a substantially U-shaped recess 50. In particular, in this example, a part of the rear end portion of the muffler device 17 is exposed to the right recess 50 formed at the connected portion between the rear fender 15 and the right rear side cover 16. That is, a part of the rear end portion of the muffler device 17 is not covered with the rear fender 15 and the right rear side cover 16.

Figure 3:
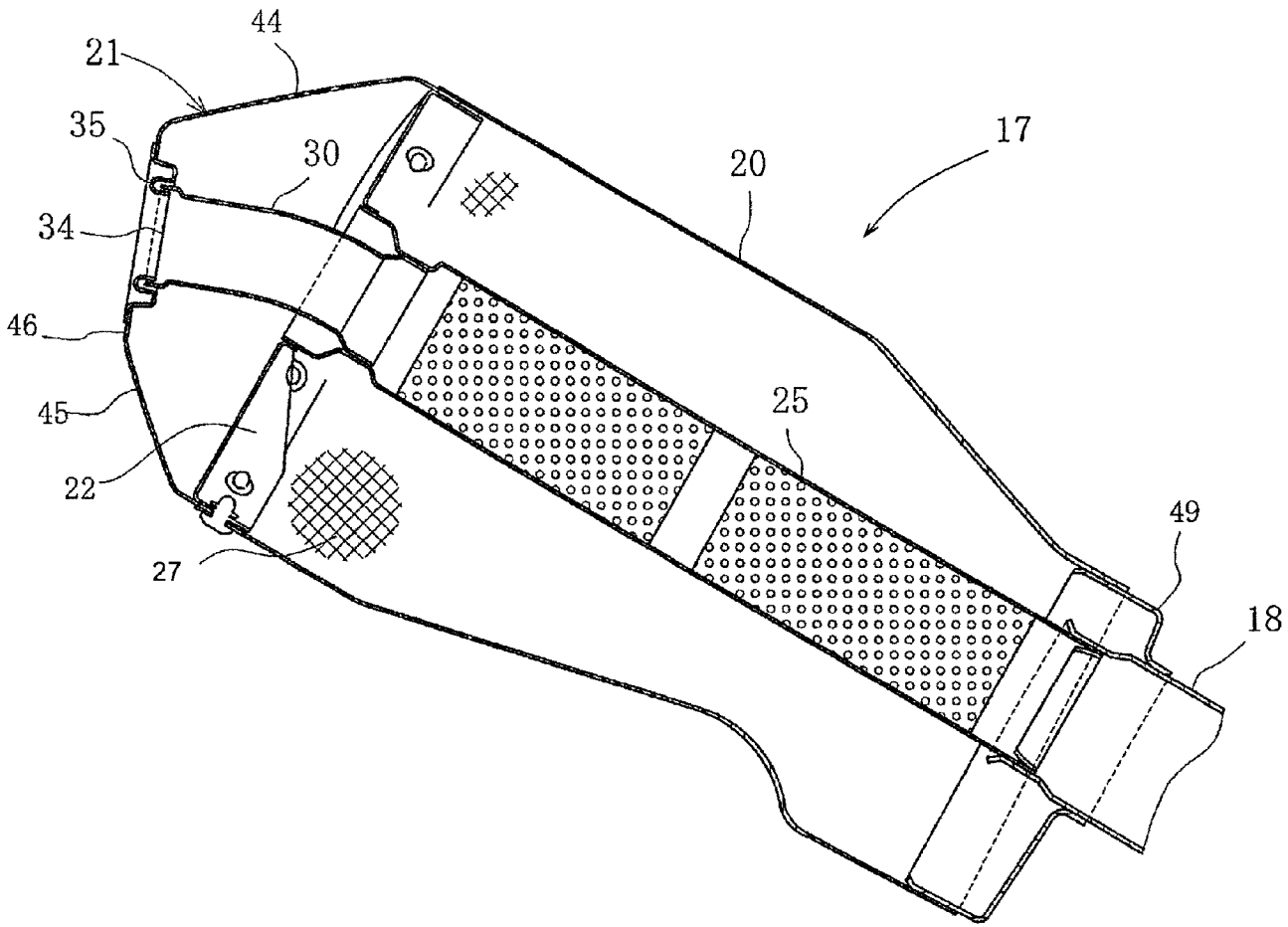
FIG. 3 is a sectional side view of the muffler device according to an embodiment.
Figure 4:
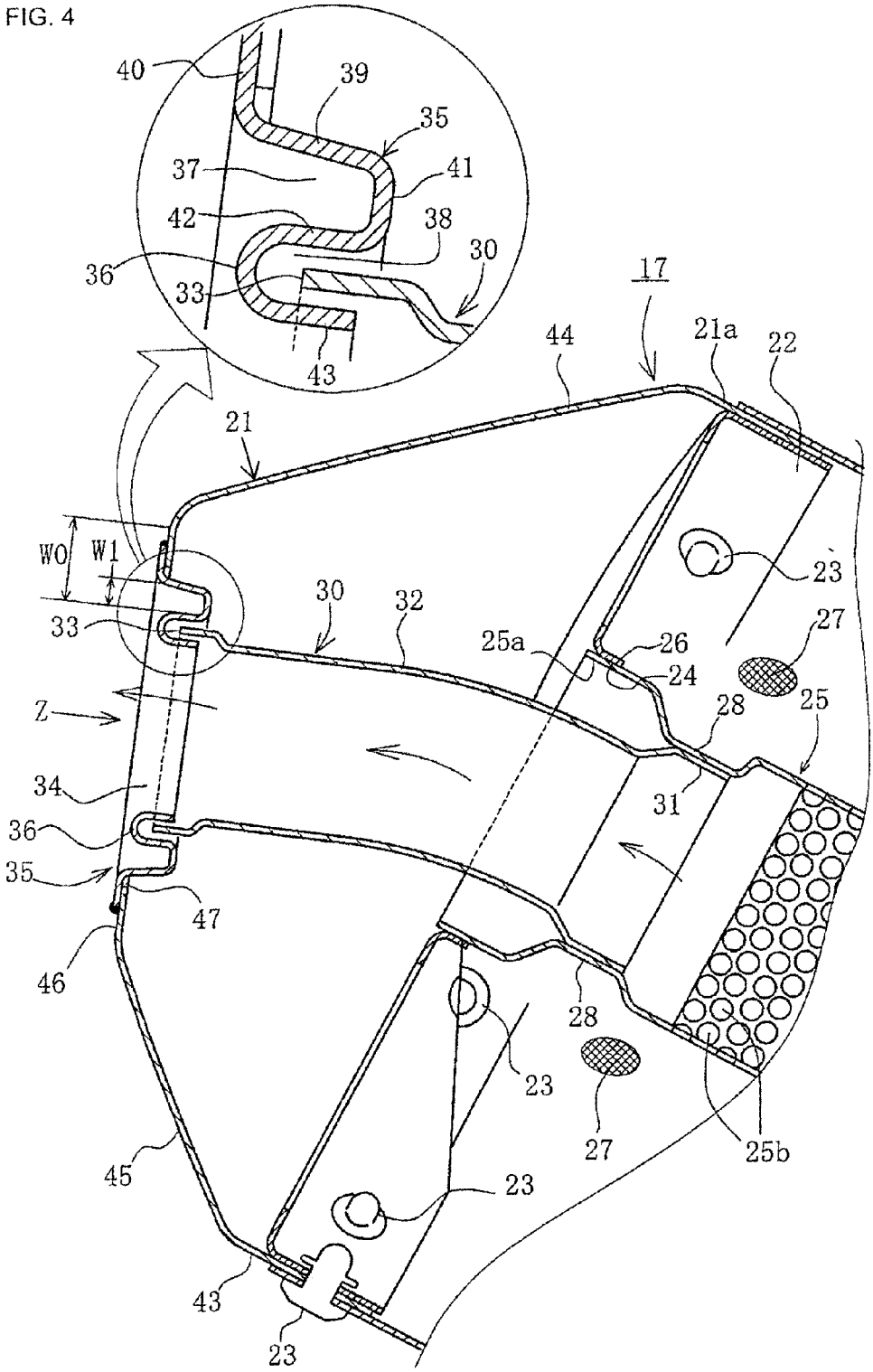
FIG. 4 is a partially enlarged, sectional side view of a rear portion of the muffler device shown in FIG. 3.
Figure 5:
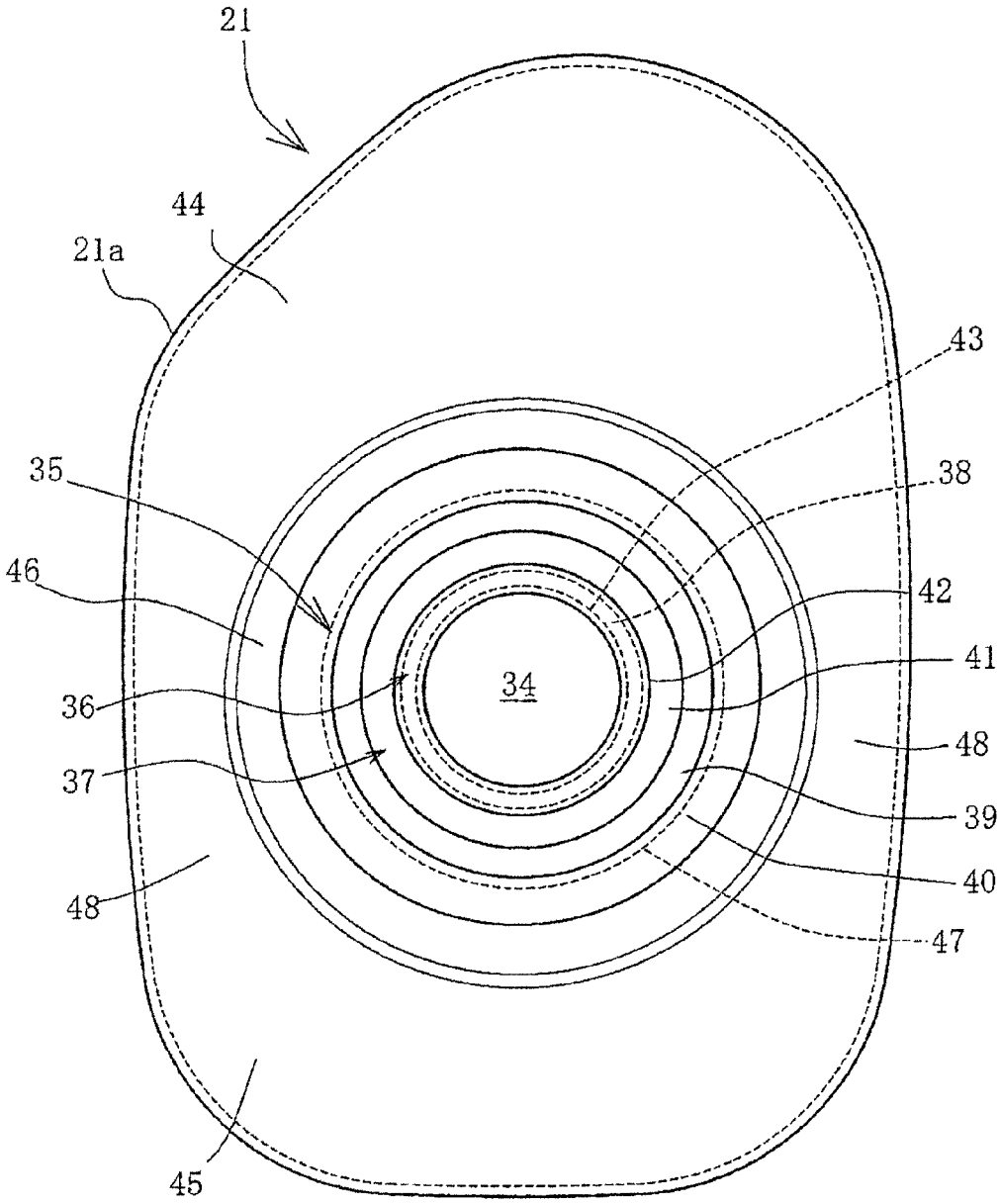
FIG. 5 is a rear view of a tail cap taken in the direction shown by an arrow Z in FIG. 4.

The structure of the muffler device 17 will now be described in detail. FIG. 3 is a sectional side view of the muffler device 17, FIG. 4 is a partially enlarged, sectional side view of a rear portion of the muffler device 17, and FIG. 5 is a view taken in the direction shown by an arrow Z in FIG. 4. As shown in the example of FIG. 3, the muffler device 17 includes a relatively thick, short muffler body 20 as an outer member, a tail cap 21 closing a rear end opening of the muffler body 20, and a front cap 49 closing a front end opening of the muffler body 20. An inner pipe 25 is accommodated in the muffler body 20 so as to extend in the longitudinal direction of the muffler body 20. The inner pipe 25 may be obtained by forming a punching metal into a cylindrical shape.

In this embodiment, the front end of the inner pipe 25 is fitted in the rear end portion of the exhaust pipe 18 supported to the front cap 49. The rear end of the inner pipe 25 is supported to a separator 22 and connected to the front end portion of a tail pipe 30. The separator 22 is fitted in the rear end opening of the muffler body 20. The rear end of the tail cap 21 is connected to an exhaust outlet 34 opening to a rear end wall 46 of the tail cap 21.

As shown in the example of FIG. 4, the tail cap has a conical shape, and its front end portion is fixed through the separator 22 to the rear end opening of the muffler body 20 by means of rivets 23.

The separator 22 has a central opening 24, and the rear end of the inner pipe 25 is fitted in the central opening 24 of the separator 22. More specifically, the inner edge of the central opening 24 of the separator 22 can be bent frontward to form an annular projection 26, and a rear end portion 25*a* of the inner pipe 25 is closely fitted to the inner circumference of the annular projection 26 and welded thereto.

According to some embodiments, the inner pipe 25 is a perforated pipe formed from a punching metal, and it is smaller in diameter than the muffler body 20 and extends in the longitudinal direction of the muffler body 20 over the length thereof. Although not shown in FIG. 4, the front end of the inner pipe 25 is connected to the rear end portion of the exhaust pipe 18 (see FIG. 1). The space defined by the inner pipe 25 and the muffler body 20 and the space defined by the tail pipe 30 and the tail cap 21 can be filled with glass wool 27 for the purpose of enhancing a noise damping effect.

According to certain embodiments, a diameter reduced portion 28 is formed at the rear portion of the inner pipe 25, and the front end of the tail pipe 30 is fitted in the diameter reduced portion 28 of the inner pipe 25. More specifically, the front end of the tail pipe 30 is enlarged in diameter to form a diameter enlarged portion 31, and this diameter enlarged portion 31 of the tail pipe 30 is closely fitted in the diameter reduced portion 28 of the inner pipe 25 and welded thereto.

The tail pipe 30 has an intermediate portion 32 smaller in diameter than the diameter enlarged portion 31, so that the intermediate portion 32 serves as a restriction for exhaust gases. The intermediate portion 32 extends rearward from the diameter enlarged portion 31 and passes through the opening 24 so as to be curved downward. The rear end of the tail pipe 30 is also enlarged in diameter to form a cut edge portion 33. The cut edge portion 33 is connected to the exhaust outlet 34 of the tail cap 21. The exhaust outlet 34 is formed at a central portion of a tail pipe supporting member 35.

The tail pipe supporting member 35 may be a ringlike small part, and have a folded portion 36 forming an opening edge of the exhaust outlet 34 and a mud guiding groove 37 formed radially outside of the folded portion 36. The tail pipe supporting member 35 can be formed by pressing or the like so that a wavy shape is formed around the exhaust outlet 34 so as to continuously form the folded portion 36 and the mud guiding groove 37.

The folded portion 36 forms a substantially U-shaped annular groove 38 opening frontward, and the cut edge portion 33 is loosely fitted in the annular groove 38.

In some embodiments, the annular groove 38 has a width considerably larger than (e.g., about twice or more) the wall thickness of the cut edge portion 33, so as to permit a change in diameter of the cut edge portion 33. That is, a change in size of the cut edge portion 33 due to thermal expansion can be absorbed by the large width of the annular groove 38.

The mud guiding groove 37 is an annular groove opening rearward. The mud guiding groove 37 has an inner circumferential wall 42, a bottom wall 41, and an outer circumferential wall 39. The inner circumferential wall 42 of the mud guiding groove 37 serves also as the outer circumferential wall of the folded portion 36. The outer circumferential wall 39 of the mud guiding groove 37 is tapered so that the width of the mud guiding groove 37 is gradually increased toward the rear opening thereof. Further, the outer circumferential wall 39 is continuously connected to an outer flange 40 at a position rearwardly projected from the rear end of the folded portion 36 by an amount corresponding to the wall thickness of the folded portion 36. Thus, the outer circumferential wall 39 is tapered so as to be diverged rearward, thereby accelerating the ejection of mud from the mud guiding groove 37. The inner circumferential wall 42 of the mud guiding groove 37 serves also as the outer circumferential wall of the annular groove 38 formed by the folded portion 36. That is, the inner circumferential wall 42 forms an intermediate wall between the mud guiding groove 37 and the annular groove 38. The annular groove 38 has an inner circumferential wall 43 parallel to the intermediate wall 42.

In one embodiment, the tail cap 21 is a conical member provided at the rear end of the muffler device 17 so that the front end opening of the tail cap 21 is largest in diameter. The front end opening of the tail cap 21 is formed with a cylindrical portion 21*a*, and this cylindrical portion 21*a* of the tail cap 21 is held between the rear end of the muffler body 20 and the outer circumferential wall of the separator 22.

The conical surface of the tail cap 21 is a tapering surface tapering toward the rear end of the tail cap 21. More specifically, the conical surface of the tail cap 21 is composed of an upper wall 44, a lower wall 45, and a pair of side walls 48 as shown in FIG. 5. The upper wall 44 is longer than the lower wall 45 as shown in FIG. 4. Accordingly, when the cylindrical portion 21*a* of the tail cap 21 is mounted to the muffler body 20 inclined upward toward the rear end thereof, the rear end wall 46 of the tail cap 21 becomes substantially vertical, that is, the exhaust outlet 34 is directed substantially horizontally rearward of the vehicle. The pair of side walls 48 are continuously connected to the upper wall 44 and the lower wall 45 as shown in FIG. 5.

The rear end wall 46 of the tail cap 21 is formed with a central opening 47, and the tail pipe supporting member 35 is fitted to the central opening 47. The outer flange 40 of the tail pipe supporting member 35 is mounted on the outer surface of the rear end wall 46 around the central opening 47, and the outer circumference of the outer flange 40 is welded to the rear end wall 46, thus integrating the tail pipe supporting member 35 with the rear end wall 46 of the tail cap 21 and closing the central opening 47 of the tail cap 21 with the tail pipe supporting member 35.

In some embodiments, the rear end of the folded portion 36 is retracted inward (frontward) from the outer surface of the outer flange 40 by an amount substantially corresponding to the wall thickness of the folded portion so as to become substantially flush with the outer surface (rear surface) of the rear end wall 46 of the tail cap 21.

As shown in the example of FIG. 5, the folded portion 36 and the mud guiding groove 37 are formed around the exhaust outlet 34 in concentric relationship with each other.

As shown in the example of FIG. 4, the mud guiding groove 37 is narrower than the rear end wall 46. That is, the width W1 of the mud guiding groove 37 is smaller than the width W0 of the rear end wall 46. For example, W1/W0 can be set to about ½ to ⅓. In one embodiment, the width W1 is set to about 4 mm, and the depth of the mud guiding groove 37 is set to about 6 mm. The width and depth of the mud guiding groove 37 may be suitably set in such a manner that the mud guiding groove 37 can exhibit capillarity to the mud having entered the groove 37.

According to the structure of the tail pipe supporting member 35, the mud accumulated on the rear end wall 46 first flows down toward the exhaust outlet 34 to enter the mud guiding groove 37. The mud next flows down in the mud guiding groove 37 around the exhaust outlet 34 and finally drops from the lower side of the exhaust outlet 34.

Accordingly, the accumulation of mud around the exhaust outlet 34 can be suppressed, so that it is possible to eliminate a possibility that the exhaust outlet 34 may be clogged with a large amount of mud.

Even when a large amount of mud is accumulated so as to fill the mud guiding groove 37 and form a mud heap, the mud in the mud guiding groove 37 is moved downward not only by the gravity, but also by the capillarity because the mud guiding groove 37 is a narrow groove opening rearward. Accordingly, the mud accumulated in the vicinity of the mud guiding groove 37 is drawn by the downward movement of the mud in the mud guiding groove 37. Thus, the mud accumulated is guided by the mud guiding groove 37 so as to be moved downward in the mud guiding groove 37 around the exhaust outlet 34, thereby eliminating the possibility that a large amount of mud may be accumulated around the exhaust outlet 34.

The tail pipe supporting member 35 as a small part is formed with the mud guiding groove 37. Accordingly, the mud guiding groove 37 can be easily formed. Furthermore, in the case of a specification change such that the specifications (e.g., outer diameter) of the tail pipe 30 are changed, it is only necessary to change the design of the tail pipe supporting member 35. Accordingly, a change in design of the tail cap 21 as a whole can be avoided, thereby improving the flexibility of design.

Further, in one example, the tail pipe supporting member 35 is formed with the folded portion 36, and the cut edge portion 33 is covered with the folded portion 36. Accordingly, although the rear end of the tail pipe 30 is formed as the cut edge portion 33, edge treatment for the cut edge portion 33 can be facilitated.

Figure 6:
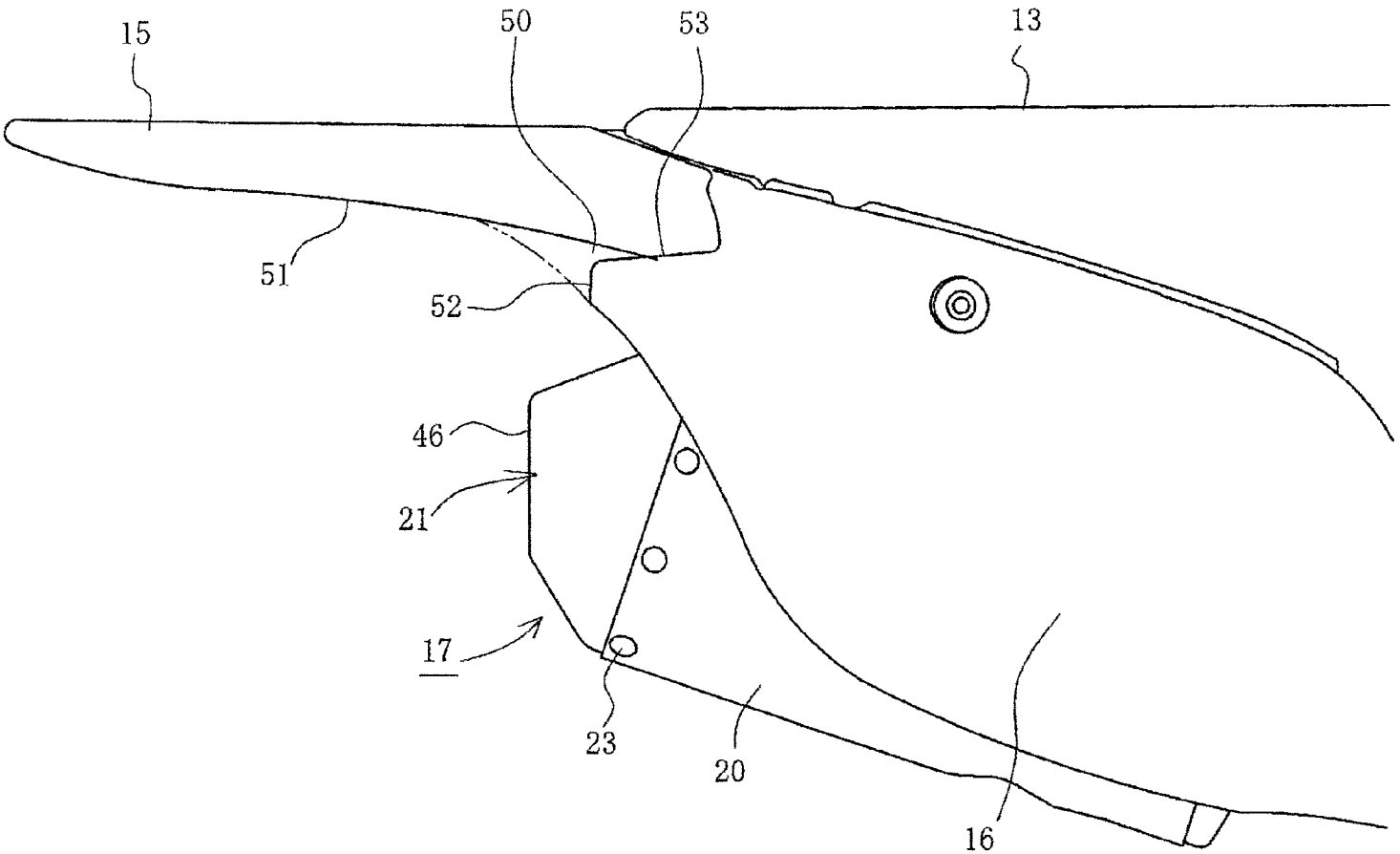
FIG. 6 is a side view showing a rear fender and rear side covers.

The relation between the rear fender 15, the rear side covers 16, and the muffler device 17 will now be described. FIG. 6 is a side view of a rear portion of the vehicle body including the rear fender 15 and the rear side covers 16, and FIG. 7 is a plan view of the rear portion shown in FIG. 6, according to one embodiment.

Figure 7:
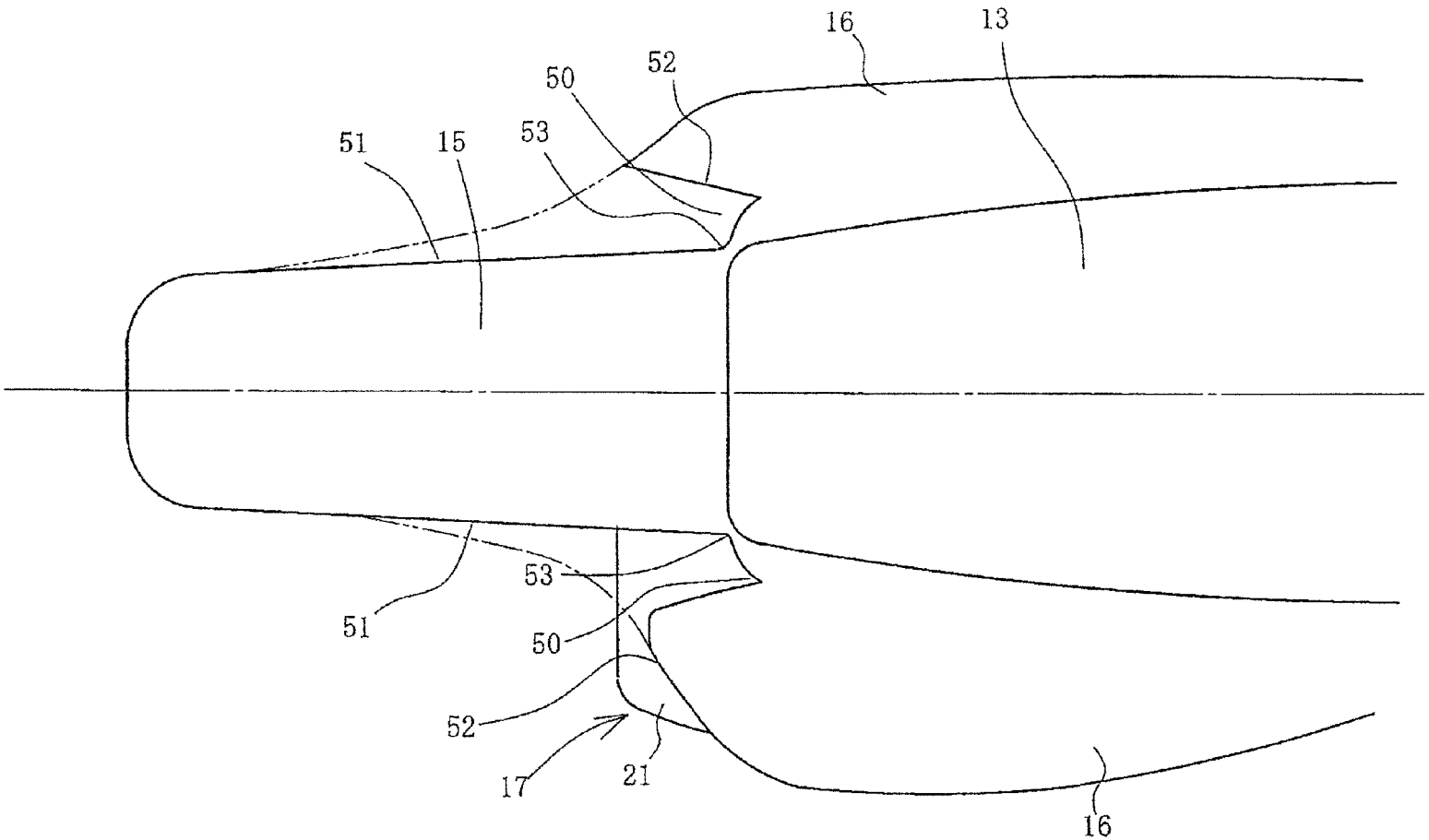
FIG. 7 is a plan view of the rear fender and the rear side covers shown in FIG. 6.

As shown in FIGS. 6 and 7, the right and left side edge portions 51 of the rear fender 15 are continuously connected at 53 to the rear edge portions 52 of the right and left rear side covers 16, respectively. As shown in FIG. 7, the rear edge portion 52 of each rear side cover 16 is cut out frontward to form the substantially V-shaped recess 50. The upper side of the tail cap 21 is exposed to the recess 50 of the right rear side cover 16 as shown in FIG. 7.

The tail cap 21 and a rear portion of the muffler body 20 are located below the right recess 50. As viewed in plan, a part of the tail cap 21 is exposed to the right recess 50 and projects rearward from the rear edge portion 52 of the right rear side cover 16 continuing to the right recess 50.

Accordingly, when the mud splashed by the rear wheel 2 falls on the rear fender 15 or the rear side covers 16, the mud flows down along the curved surface of the rear fender 15 to the recesses 50 of the rear side covers 16.

As a result, the mud on the rear fender 15 can be easily dropped through the right recess 50 onto the tail cap 21, and the mud on the right rear side cover 16 near the right recess 50 can also be dropped through the right recess 50 onto the tail cap 21. The mud dropped onto the tail cap 21 can be smoothly dropped along the mud guiding groove 37 having the mud ejection accelerating effect mentioned above without clogging the exhaust outlet 34.

In this manner, the mud accumulated near the connected portion between the rear fender 15 and each rear side cover 16 can be easily dropped through each recess 50, thus preventing the accumulation of mud at this connected portion. Further, the mud dropped through the right recess 50 can be received by the tail cap 21 and smoothly dropped along the mud guiding groove 37 so as not to clog the exhaust outlet 34 as mentioned above. That is, the ejection of mud can be attained by using the muffler device 17 configured as a short muffler.

Thus, it is possible to suppress the accumulation of mud at the connected portion between the rear fender 15 and each rear side cover 16 and on the rear end wall 46 of the tail cap 21, and the mud can be smoothly dropped to the ground. Accordingly, even in the case of running the vehicle on a muddy road as in a motocross race and splashing a large amount of mud, the clogging of the exhaust outlet 34 with the mud can be prevented and the muffler device 17 is therefore most suitable for this kind of application.

Figure 8:
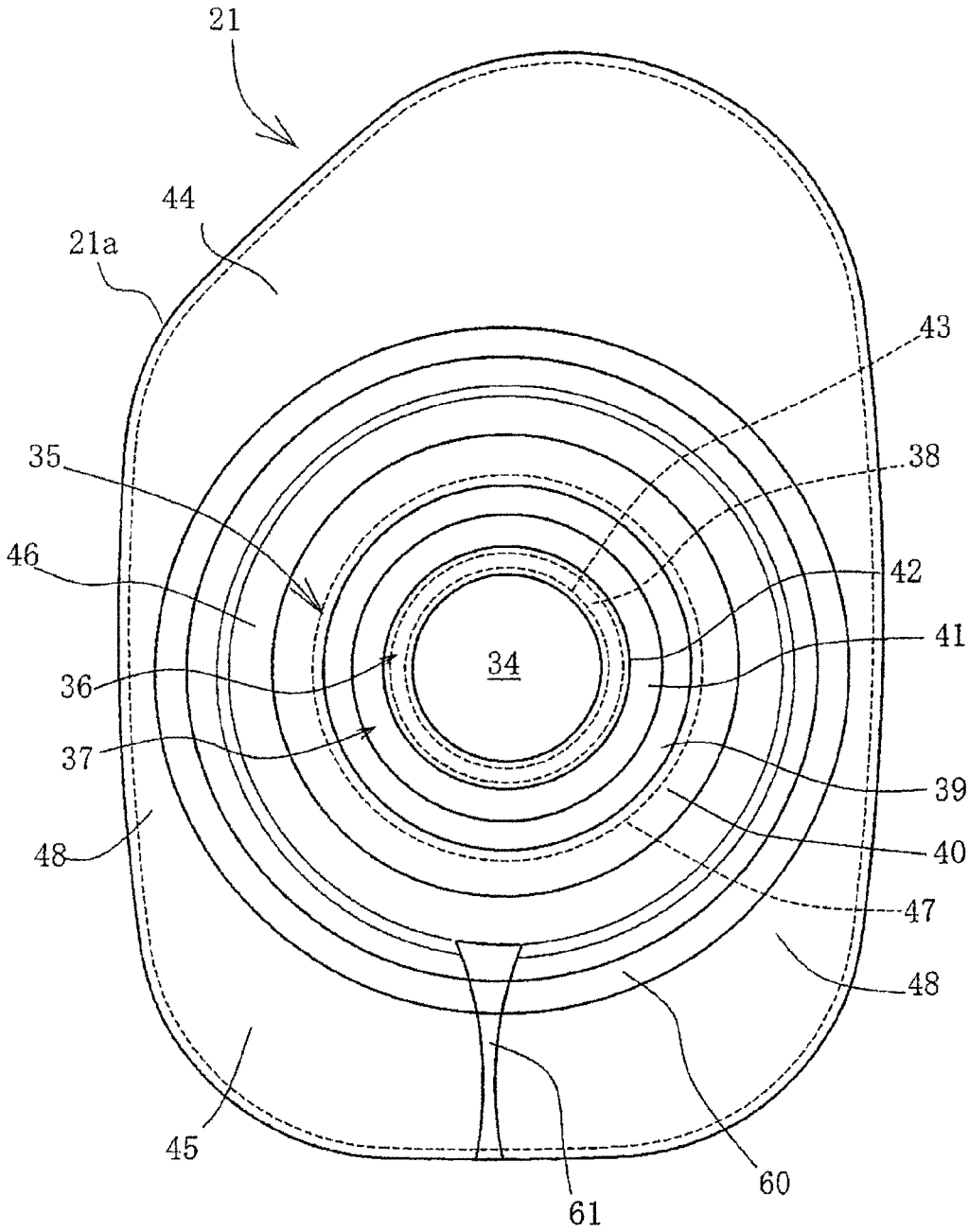
FIG. 8 is a view similar to FIG. 5, showing another embodiment of the present invention.

FIG. 8 is a view similar to FIG. 5, showing a another embodiment of the present invention. In FIG. 8, substantially the same parts as those shown in FIG. 5 are denoted by the same reference numerals. In the embodiment shown in FIG. 8, a second mud guiding groove 60 concentric with the mud guiding groove 37 is formed on the tapered circumferential wall (continuous wall composed of the upper wall 44, the lower wall 45, and the right and left side walls 48) around the rear end wall 46. Further, a third mud guiding groove 61 is formed on the lower wall 45 so as to extend substantially straight downward from the lower end of the rear end wall 46.

With this structure, the mud accumulated on the tapered circumferential wall can also be easily moved along the second mud guiding groove 60. Also in this case, the second mud guiding groove 60 can exhibit capillarity to thereby accelerate the movement of the mud. Further, the mud moved down along the second mud guiding groove 60 and the mud moved downward along the mud guiding groove 37 or on the rear end wall 46 without being guided by the mud guiding groove 37 are guided by the third mud guiding groove 61 so as to be smoothly dropped to the ground. Accordingly, the mud can be efficiently removed by extensively providing the plural mud guiding grooves 37, 60, and 61.

Figure 9:
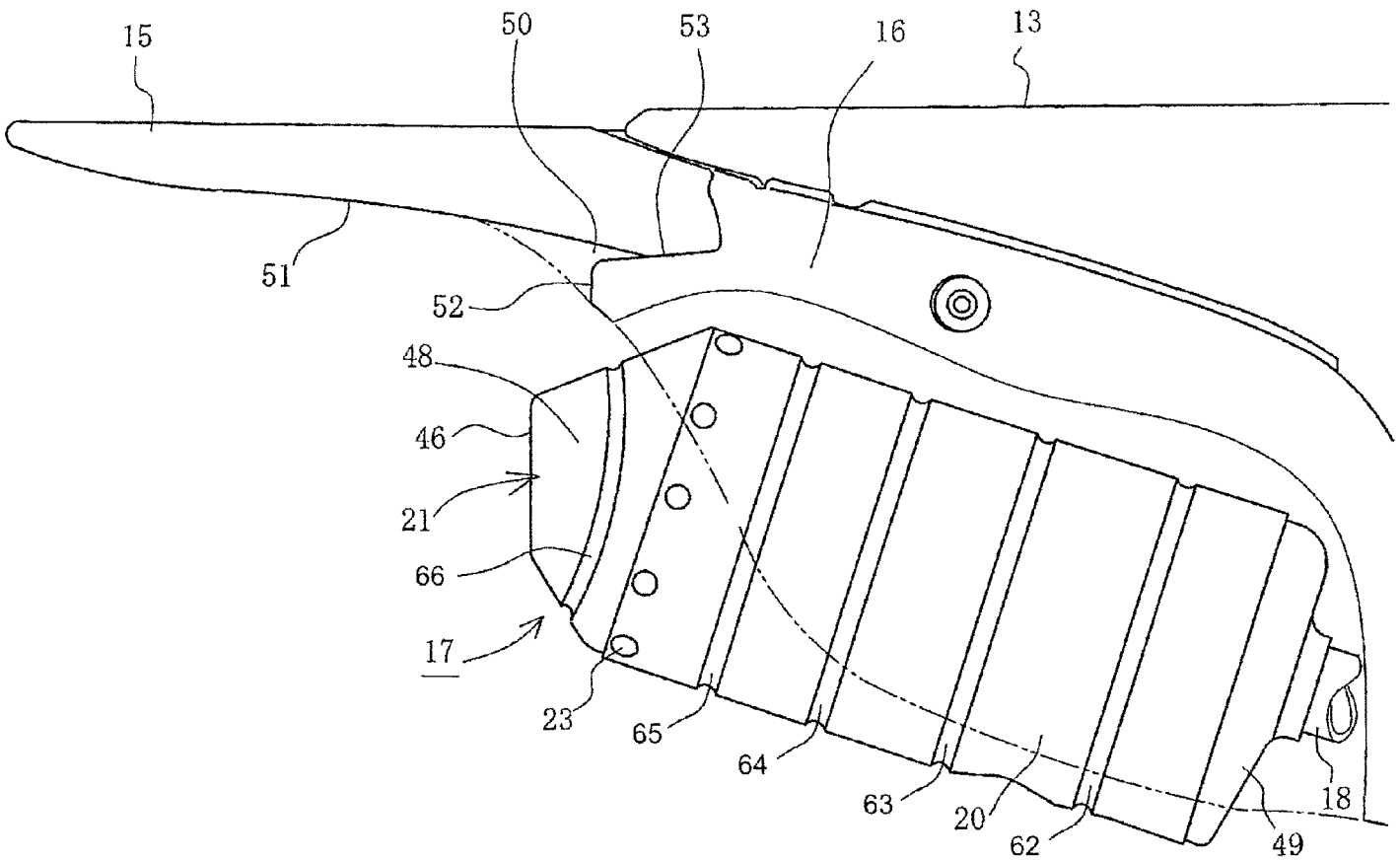
FIG. 9 is a view similar to FIG. 6, showing another embodiment of the present invention.

FIG. 9 is a view similar to FIG. 6, showing another embodiment of the present invention. That is, FIG. 9 is a side view of the muffler device 17 with a part of the right rear side cover 16 cut away. In the embodiment shown in FIG. 9, a plurality of annular mud guiding grooves 62 to 65 are formed on the outer cylindrical surface of the muffler body 20 in such a manner as to be arranged in parallel to each other as viewed in side elevation. With this structure, the mud accumulated on the muffler device 17 can be efficiently removed along these mud guiding grooves 62 to 65.

Further, an annular mud guiding groove 66 can also be formed on the tapered circumferential wall of the tail cap 21 as similar to the embodiment shown in FIG. 8. Accordingly, the mud guiding groove 66 functions similarly to the second mud guiding groove 60 shown in FIG. 8 to thereby efficiently remove the mud accumulated on the tapered circumferential wall of the tail cap 21.

DESCRIPTION OF REFERENCE NUMERALS

2: Rear wheel, 15: Rear fender, 16: Rear side cover, 17: Muffler device, 20: Muffler body, 21: Tail cap, 25: Inner pipe, 30: Tail pipe, 34: Exhaust outlet, 35: Tail pipe supporting member, 37: Mud guiding groove, 46: Rear end wall, 50: Recess, 60: Second mud guiding groove, 61: Third mud guiding groove, 62 to 66: Mud guiding groove

We claim:

1. A muffler device for a motorcycle, the muffler device comprising:
- an exhaust pipe having one end connected to an exhaust port of an engine and a muffler connected to the other end of said exhaust pipe;
- said muffler comprising
  - a muffler body as an outer member,
  - a tail cap closing a rear end opening of said muffler body,
  - an inner pipe accommodated in said muffler body,
  - a tail pipe accommodated in said muffler body and connected to said inner pipe, said inner pipe having one end connected to said exhaust pipe, said tail pipe having one end connected to an exhaust outlet formed through said tail cap, and
  - a folded portion forming an opening edge of the exhaust outlet;
  - wherein said tail cap is formed with an annular mud guiding groove as a narrow groove surrounding said exhaust outlet,
  - wherein the annular mud guiding groove comprises an inner circumferential wall, a bottom wall, and an outer circumferential wall,
  - wherein the outer circumferential wall is tapered so that a width of the annular mud guiding groove is gradually increased toward a rear opening thereof, and the outer circumferential wall is continuously connected to an outer flange at a position rearwardly projected from an end of the folded portion.

2. The muffler device according to claim 1, wherein said muffler further comprises a tail pipe supporting member configured to support one end of said tail pipe, said tail pipe supporting member being integrated with said tail cap and having said exhaust outlet and said mud guiding groove.

3. The muffler device according to claim 2, wherein one end of said tail pipe supported by said tail pipe supporting member is formed as a cut edge portion, and said tail pipe supporting member is formed with an annular folded portion for covering said cut edge portion.

4. The muffler device according to claim 1, wherein said tail cap is further formed with a second mud guiding groove extending substantially straight downward from a lowermost end of said annular mud guiding groove.

5. A muffler device for a motorcycle, the muffler device comprising:
- exhaust pipe means for discharging exhaust, the exhaust pipe means having one end connected to an exhaust port of an engine and muffler means connected to the other end of said exhaust pipe means;
- said muffler means comprising
  - a muffler body as an outer member,
  - tail cap means for closing a rear end opening of said muffler body,
  - an inner pipe accommodated in said muffler body, a tail pipe accommodated in said muffler body and connected to said inner pipe, said inner pipe having one end connected to said exhaust pipe means, said tail pipe having one end connected to an exhaust outlet formed through said tail cap means, and folded portion means for forming an opening edge of the exhaust outlet;

wherein said tail cap means is formed with annular mud guiding groove means for narrowly surrounding said exhaust outlet, wherein the annular mud guiding groove means comprises an inner circumferential wall, a bottom wall, and an outer circumferential wall, wherein the outer circumferential wall is tapered so that a width of the annular mud guiding groove means is gradually increased toward a rear opening thereof, and the outer circumferential wall is continuously connected to an outer flange at a position rearwardly projected from an end of the folded portion means.

6. The muffler device according to claim 5, wherein said muffler means further comprises tail pipe supporting member means for supporting one end of said tail pipe, said tail pipe supporting member means being integrated with said tail cap means and having said exhaust outlet and said mud guiding groove means.

7. The muffler device according to claim 6, wherein one end of said tail pipe supported by said tail pipe supporting member means is formed as a cut edge portion, and said tail pipe supporting member means is formed with an annular folded portion for covering said cut edge portion.

8. The muffler device according to claim 5, wherein said tail cap means is further formed with a second mud guiding groove means extending substantially straight downward from a lowermost end of said annular mud guiding groove means.

* * * * *